US008491450B2

(12) United States Patent
Perry, Jr.

(10) Patent No.: US 8,491,450 B2
(45) Date of Patent: Jul. 23, 2013

(54) ROTARY, ADJUSTABLE BODY EXERCISE EQUIPMENT

(76) Inventor: Leroy R. Perry, Jr., Altadena, CA (US)

( * ) Notice: Subject to any disclaimer, the term of this patent is extended or adjusted under 35 U.S.C. 154(b) by 253 days.

(21) Appl. No.: 12/927,170

(22) Filed: Nov. 9, 2010

(65) Prior Publication Data

US 2011/0118095 A1 May 19, 2011

Related U.S. Application Data

(60) Provisional application No. 61/281,119, filed on Nov. 13, 2009.

(51) Int. Cl.
*A63B 26/00* (2006.01)

(52) U.S. Cl.
USPC ..... 482/142; 482/143; 482/144

(58) Field of Classification Search
USPC ..... 482/95, 96, 97, 135, 142, 143, 144, 482/145, 148, 907, 908; 606/241, 242, 243, 606/245; 602/32, 33, 34, 35, 36; 601/23, 601/24
See application file for complete search history.

(56) References Cited

U.S. PATENT DOCUMENTS

| | | | | | |
|---|---|---|---|---|---|
| 4,292,962 | A * | 10/1981 | Krause | 606/244 |
| 4,461,287 | A * | 7/1984 | Takahashi | 482/144 |
| 4,566,693 | A * | 1/1986 | Seidentop et al. | 482/144 |
| 4,703,929 | A * | 11/1987 | Reed | 482/144 |
| 4,753,438 | A * | 6/1988 | Paris et al. | 482/144 |
| 5,135,459 | A | 8/1992 | Perry, Jr. | |
| 5,221,246 | A * | 6/1993 | Torii | 482/144 |
| 5,295,936 | A * | 3/1994 | Perry, Jr. | 482/144 |
| 6,030,325 | A * | 2/2000 | Ottoson et al. | 482/144 |
| 6,443,879 | B1 * | 9/2002 | Chen | 482/144 |
| 7,699,763 | B2 * | 4/2010 | Perry, Jr. | 482/144 |
| 2007/0298948 | A1 * | 12/2007 | Chen | 482/144 |
| 2008/0200319 | A1 * | 8/2008 | Fong | 482/144 |

* cited by examiner

*Primary Examiner* — Glenn Richman
(74) *Attorney, Agent, or Firm* — William W. Haefliger

(57) ABSTRACT

Provision of bodily exercise equipment, including providing an upright frame and an assembly rotatable about a primary transverse axis while supported by the frame, the assembly including a body support platform, a leg support spaced from the platform, a linearly adjustable element to linearly adjust the position of the leg support, an angularly adjustable element or elements to angularly adjust the position of the leg support about a second transverse axis relative to the platform. The space between the platform and the leg support allows the standing user to position his body adjacent the platform and to position his legs adjacent the leg support.

15 Claims, 10 Drawing Sheets

FIG. 11
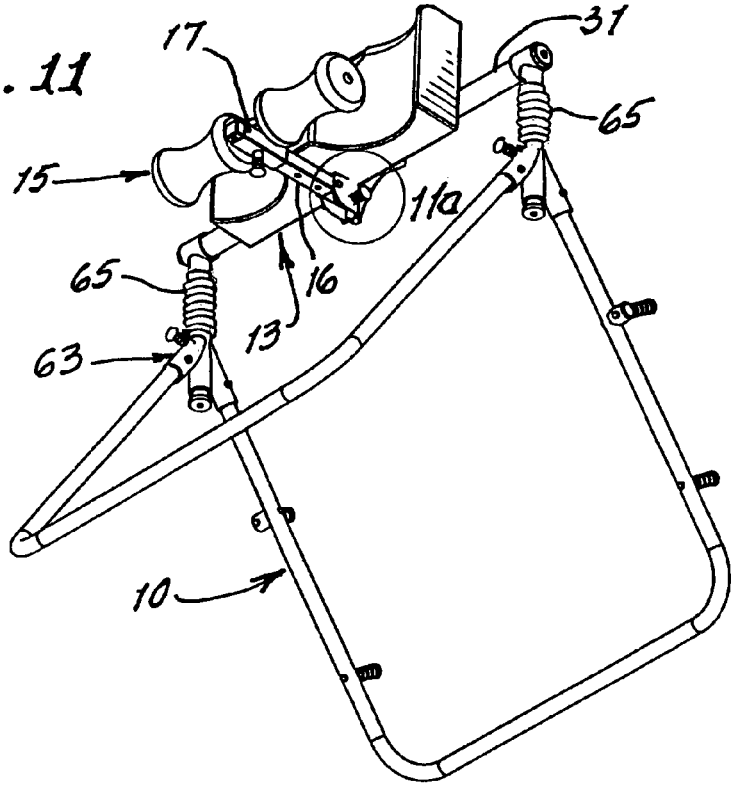
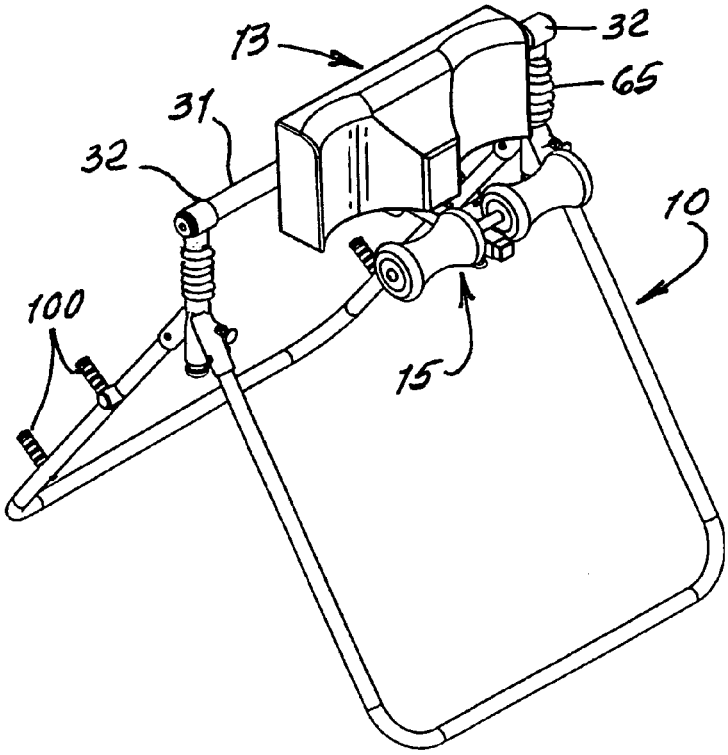
FIG. 12

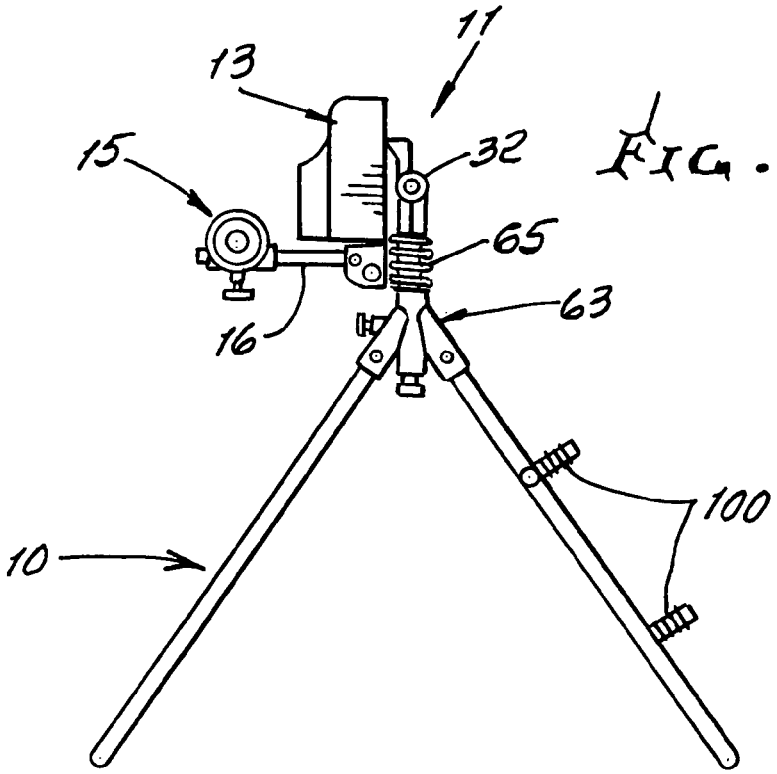
FIG. 13
FIG. 14
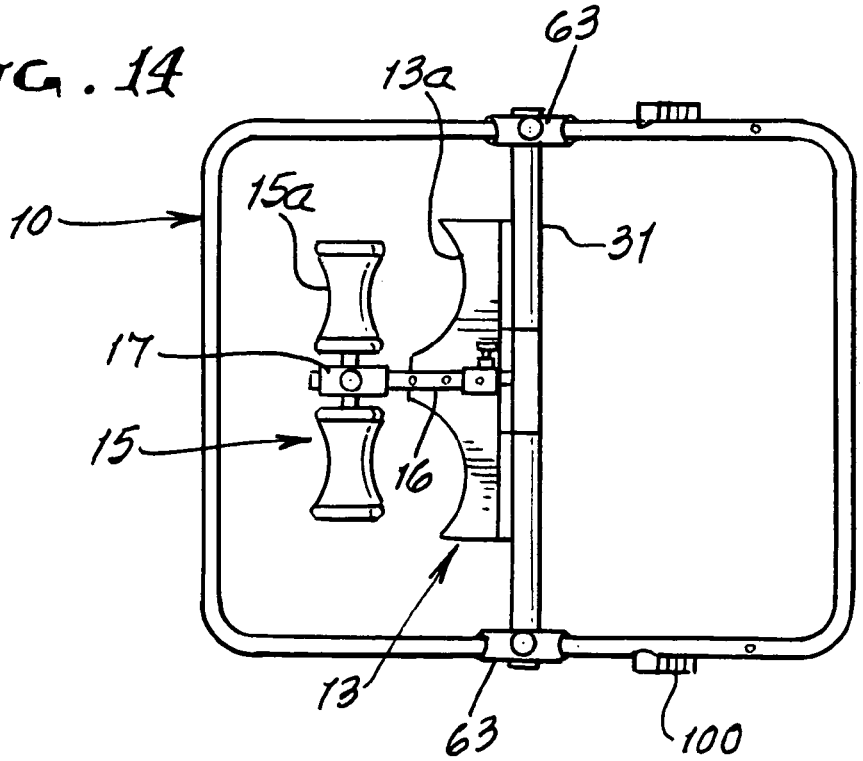

15 DEGREES

40 DEGREES

65 DEGREES

90 DEGREES

ROTARY, ADJUSTABLE BODY EXERCISE EQUIPMENT

This application claims priority from provisional application Ser. No. 61/281,119 filed Nov. 13, 2009.

BACKGROUND OF THE INVENTION

This invention relates generally to exercise equipment, and particularly which enables an assured wide range of user body angular positions about a horizontal axis, for example to achieve stretching of the adductor musculature while contracting the abductor muscles producing posterior or external rotation of the user's ilium, thereby inducing distraction of the user's inguinal ligaments and associated adductor musculature anterior. The invention also allows the user to perform stretching of the opposite abductor musculature while contracting the adductor muscles producing anterior or internal rotation of the user's ilium, thereby inducing distraction of the user's sacroiliac joints and associated abductor musculature posterior. Both anterior and posterior movements of the ilium are achieved as the result of pivoting about a horizontal axis with varied degrees of leg, knee, thigh, trunk extension, flexion and rotation.

The invention also enables user achievement of greater spinal stretching, decompression, and strengthening of the hamstrings, gluteus maximus, erector spinae and other associated spinal muscles, tendons and ligaments while strengthening abdominal core strength.

There is need for simple, rugged, durable, easily usable and response equipment and method of its use that safely allows achievement of the described exercise positions and results.

SUMMARY OF THE INVENTION

It is a major object of the invention to provide exercise equipment that meets the above needs.

Basically, the equipment provision includes:

a) providing an upright frame and an assembly rotatable about a primary transverse axis while supported by the frame, the assembly including i) a body support platform and support structure supporting the platform, ii) a leg support spaced from the platform, iii) a linearly adjustable element carried by the support structure to linearly adjust the position of the leg support relative to the platform, iv) an angularly adjustable element or elements associated with the linearly adjustable element to angularly adjust the position of the leg support relative to the platform, b) the space between the platform and the leg support allowing the standing user to position his body adjacent the platform and to position his legs adjacent the leg support, c) there being a vertically adjustable post or posts carried by the frame that supports the rotary assembly for substantially vertical pre-adjustment by the standing user, d) the assembly then being rotatable about said axis to selected body and leg position or positions, by the user, while the user's body and legs are confined by the platform and the leg support.

A further object is to provide a cross bar supported by the posts for rotation about said axis of assembly rotation, said assembly rotatably carried by the cross bar, the cross bar being vertically adjustable with the posts. Typically a spring or springs is or are associated with the posts to urge them upwardly, the springs compressed by the weight of the assembly and cross bar. Also, at least one stop may be associated with the cross bar and post or posts, positioned to stop rotation of the cross bar when the platform is initially engageable by the user's body in standing position, whereby the user's weight is progressively transformed to the platform as the platform rotates about the axis of rotation. Lock means may be provided to hold the springs in selectable compressed condition, in selected post vertically adjusted position or positions, enabling use by persons of varied height.

Another object is to provide lock means to lock the angularly adjustable element or elements to hold the leg support in selected angularly adjusted position about a secondary transverse axis relative to the platform, whereby support of the user's legs is selectively angularly adjustable, for rotation about said primary transverse axis. Such lock means preferably has lock positions at least. Additional lock means is preferably provided to lock the linearly adjustable element or elements to hold the leg support in selected linearly adjusted and extended position relative to the platform, whereby the leg support is selectably linearly adjusted in spaced relation to said primary axis and to said platform.

A further object is to provide the angularly adjustable element or elements to define a T-brace, the leg support including two transversely spaced, generally cylindrical leg engaging positioners carried by the T-brace.

These objects are embodied in equipment to be described and preferably configured to achieve the exercise positions and results, as referred to above.

An added object is to provide a method of providing for positioning and use of rotary body supporting exercise equipment facilitating initial and subsequent physical adaptation of the user to the equipment, for each of body rotation and exercise, and which comprises:

positioning the rotatable assembly, rotatably and vertically, relative to a user's body in standing position, to adjustably locate the platform lengthwise adjacent a selected frontal part of the torso or upper legs of the user's body, adjusting the linearly adjustable element to adjust the location of the leg support relative to the located platform and to the user's lower legs, and adjusting the angularly adjustable element or elements at or to a selected angle between 0° and 90° to locate the leg support angularly adjacent the standing user's legs.

The method further typically includes locking the rotatable assembly into a selected vertical position relative to the standing user, and locking equipment components at the adjusted positions referred to.

These and other objects and advantages of the invention, as well as the details of an illustrative embodiment, will be more fully understood from the following specification and drawings, in which:

DRAWING DESCRIPTION

Figure 1:
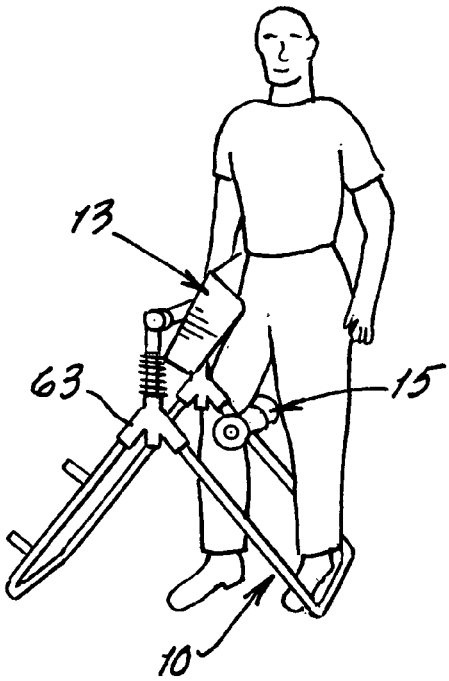
FIGS. 1-6 show various positions of exercise apparatus incorporating the invention.
Figure 2:
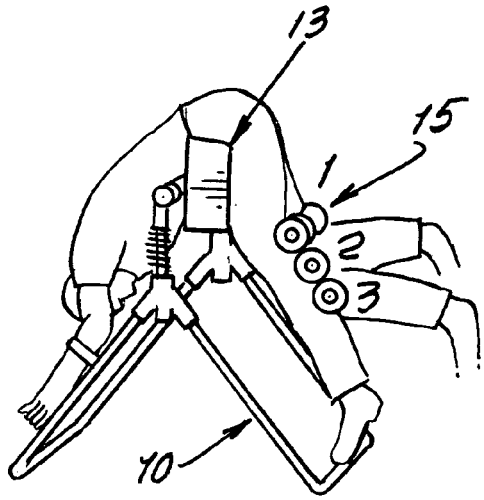
Figure 3:
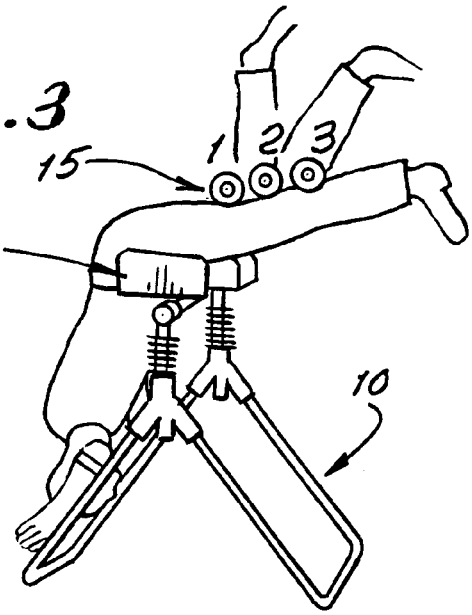
Figure 4:
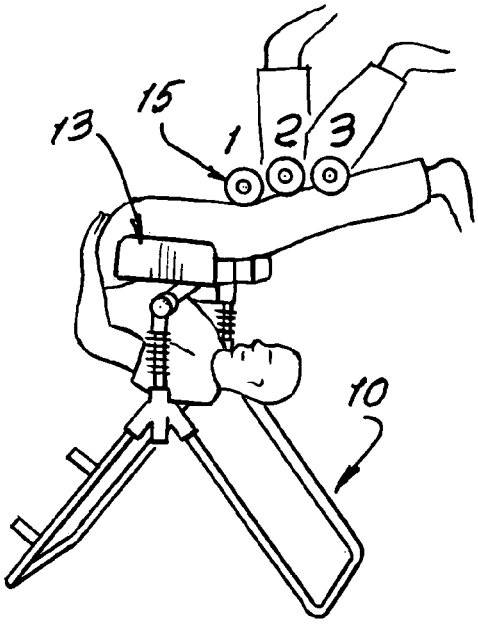
Figure 5:
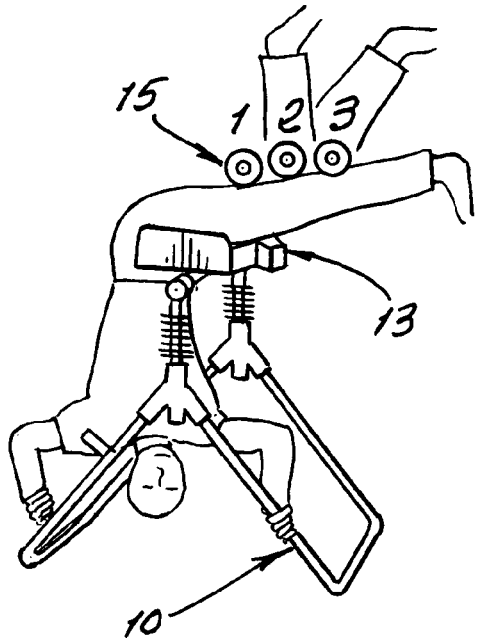
Figure 6:
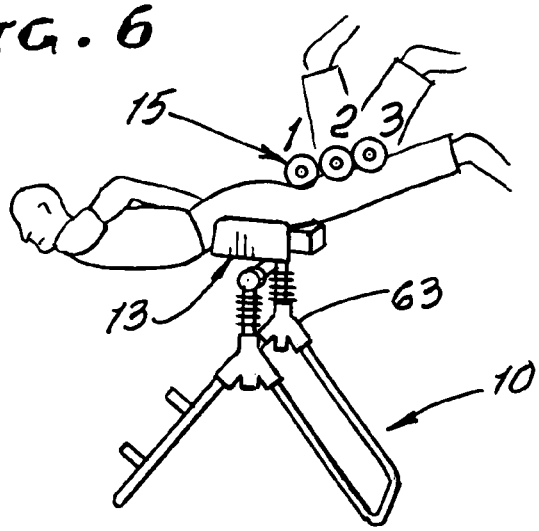
Figure 7:
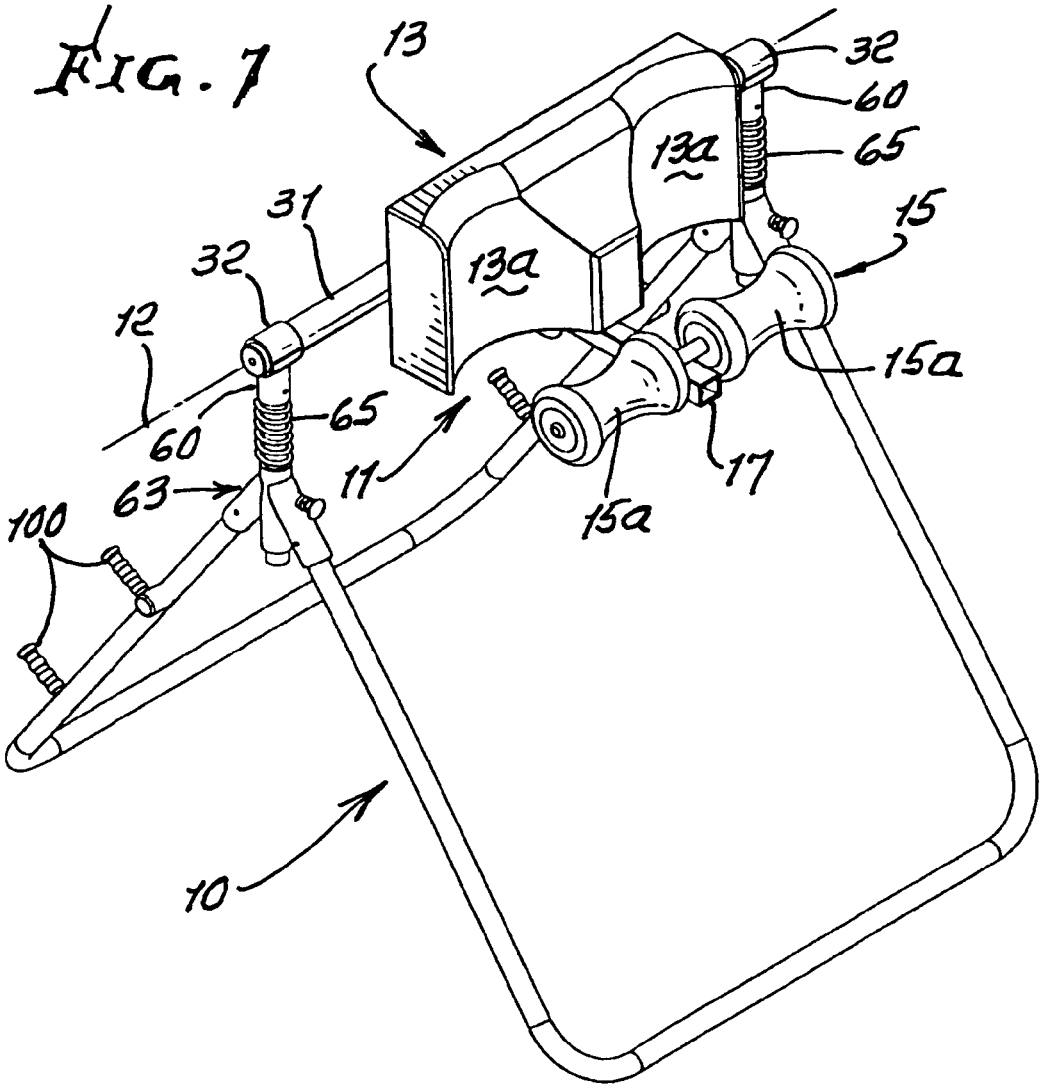
FIG. 7 is a perspective view of apparatus incorporating the invention.
Figure 7A:
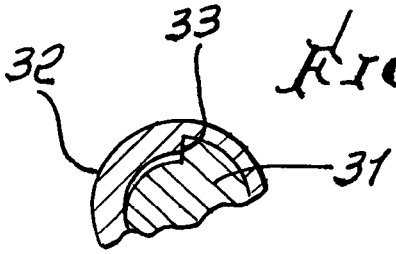
Figure 8:
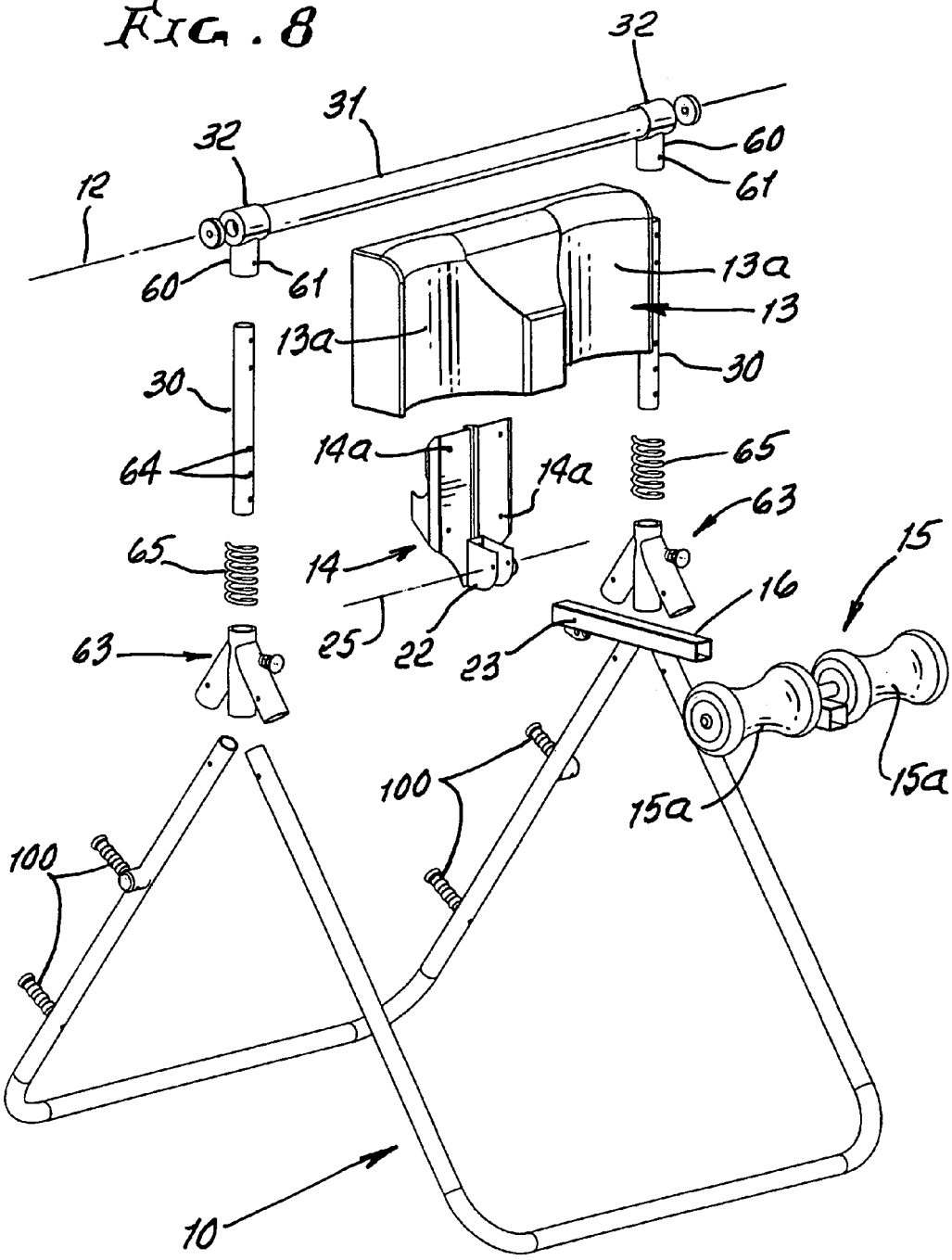
Figure 9:
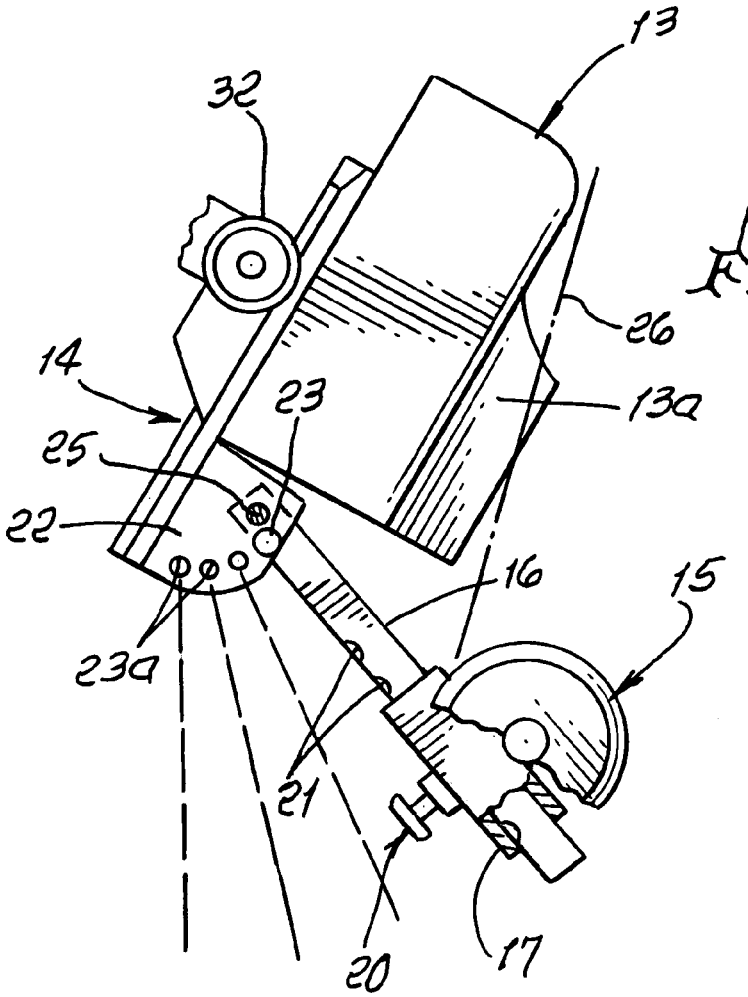
Figure 9A:
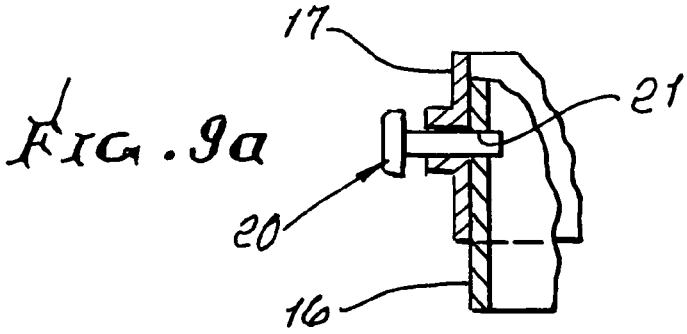
Figure 10:
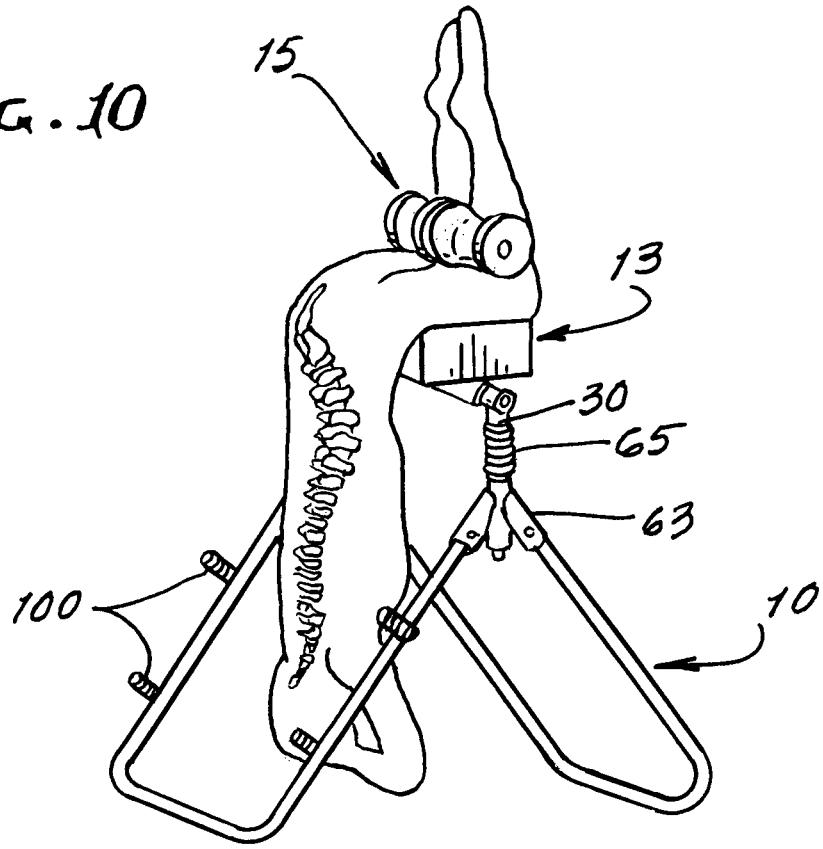
Figure 11A:
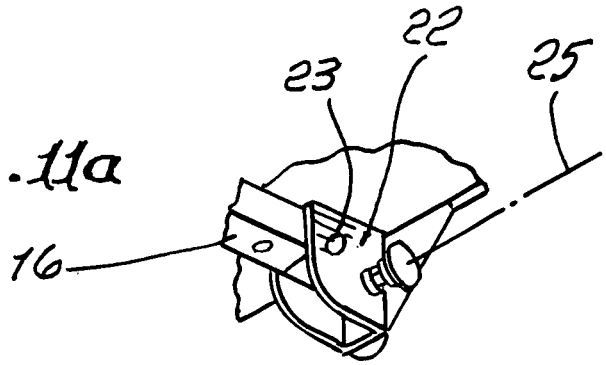
Figure 15:
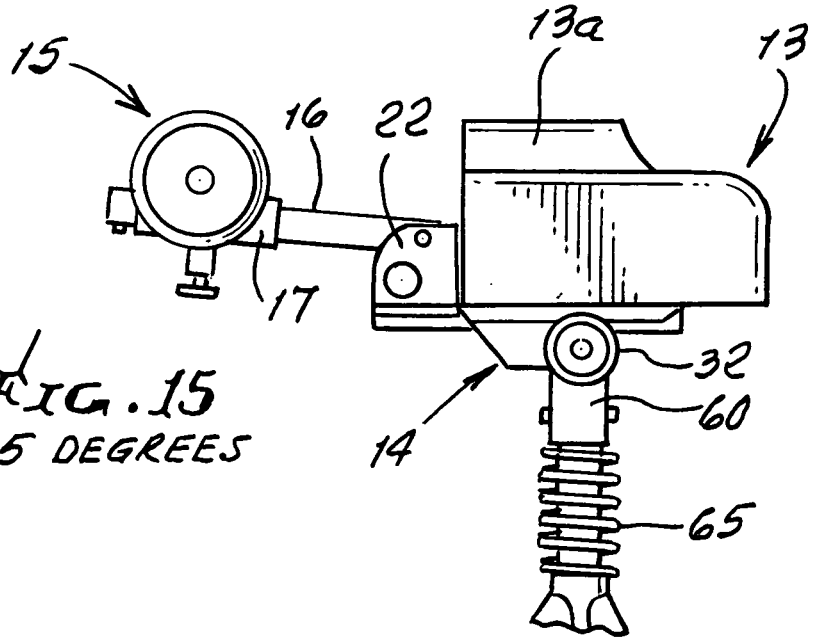
Figure 16:
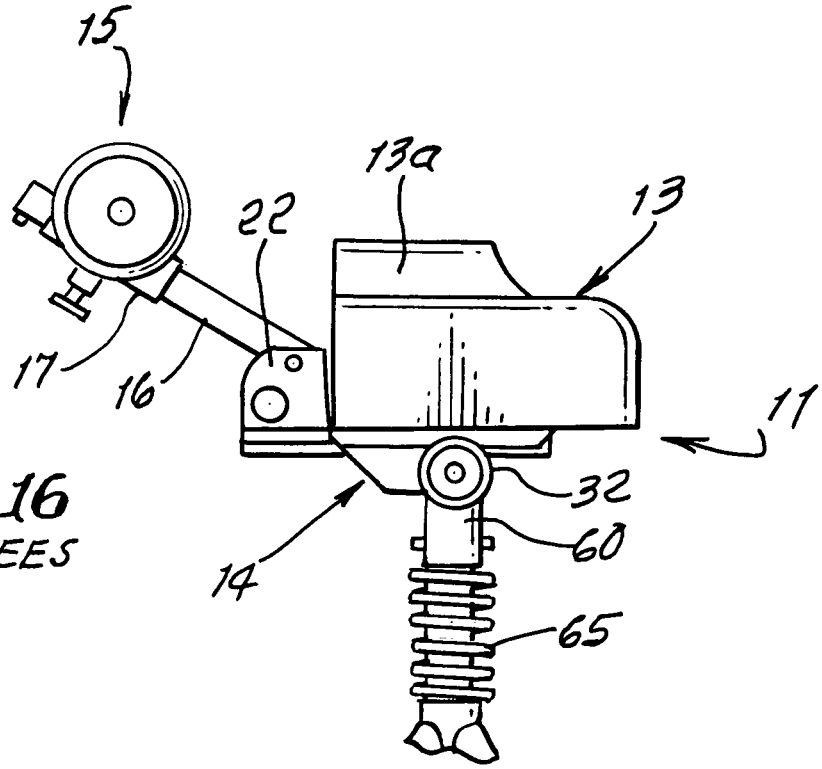
Figure 17:
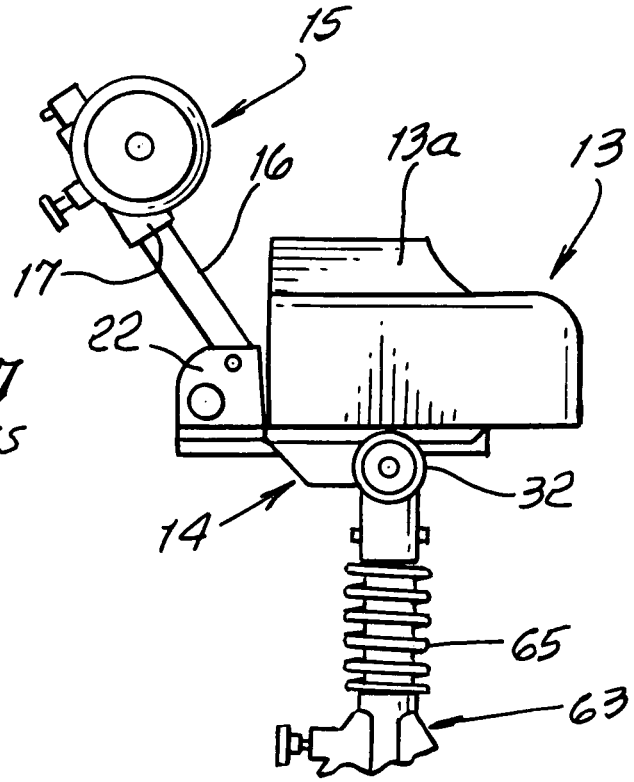
Figure 18:
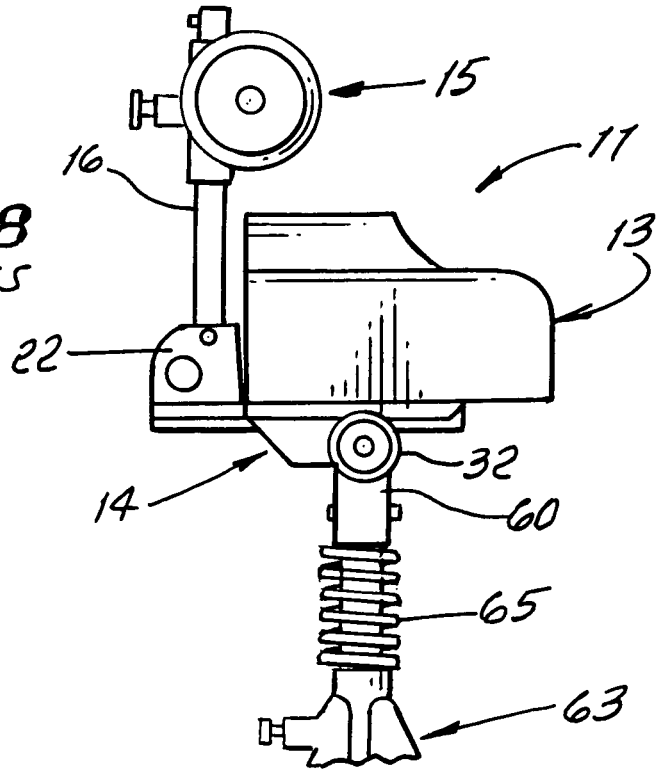

FIG. 7*a* is an enlarged section showing stops,

FIG. 8 is an exploded view of the FIG. 1 apparatus;

FIG. 9 is a side elevation showing linearly adjustable elements of the rotary assembly, and angularly adjustable elements of the assembly;

FIG. 9*a* is a section showing locking means;

FIG. 10 is a perspective view showing a gravity traction position;

FIGS. 11-14 show added views of representative apparatus; and

FIGS. 15-18 diagrammatically show selectable annular positions of leg supports.

DETAILED DESCRIPTION

Referring first to FIGS. 7, 8 and 9, provision of bodily exercise equipment, includes:

a) providing an upright frame 10 and an assembly 11 rotatable about a primary transverse axis 12 while supported by the frame. The assembly includes:

i) a body or upper leg support platform 13 with concave surfaces 13*a* and support structure 14 supporting the platform. It is shown attached at 14*a* to the rear side of the platform, ii) lower leg support 15 is spaced from the platform, to allow user's body adjusted positions lengthwise between 13 and 15.

iii) a linearly adjustable element or elements 16 and 17 is carried by the support structure to linearly adjust the position of the leg support relative to the platform. See strut 17 lengthwise adjustable telescopically along strut 16, both having rectangular cross sections to prevent their relative rotation. Lock pins at 20 carried by 17 push into openings 21 in strut 16 to hold 17 and support 15 in adjusted extended position, and adjust the space between 15 and 13 engaged by the user. Supports 15*a* extend at opposite sides of 16 and 17.

iv) An angularly adjustable element or elements at 22 and 23 is or are associated with the linearly adjustable element to angularly adjust the position of the leg support 15 relative to the platform 13. Similar lock pins 23 carried by 16 push into openings 23*a* in 22 (attached to 14) for angular locking of 16, 17 and 15, at angles between 0° and 90°. Structure 22 supports 16 for rotation, about a second transverse axis 25.

b) The space 26 between the platform and the leg support allows the standing user to initially position his body or upper legs adjacent the platform and to position his lower legs adjacent the leg support. Angular adjustment of 15 positions and supports the user's lower legs, for rotation.

c) A vertically adjustable post or posts 30 is or are carried by the frame to support the rotary assembly 11 for substantially vertical pre-adjustment relative to the standing user, for best and safe support of the user during rotation, about axis 12. See cross bar 31 having ends carried by the posts, to define axis 12 and to which support 14 is connected. Bar 31 is supported in bearings at 32. Posts 30 telescope in upper sleeves 60 and pin connect via openings 61. The post lower portions pin connect to delta shaped supports 63, as via openings 64 allowing height adjusting of bar 31. Springs 65 resist lowering of bar 31. See FIG. 8. FIG. 7*a* shows a stop at 33 to block rotation when the platform is in FIG. 9 stable position to allow user standing entry into the equipment.

d) The assembly is rotatable about axis 12 to selected body and leg position or positions, by the user, while the user's body and legs are safely and supportably confined by the platform 13 and the concavely recessed leg supports 15.

FIGS. 1-6 and 10 show use and method of use of the equipment, for the associated described exercises. In these views, the labels 1, 2 and 3 refer to selected positions of the lower leg support or supports 15.

FIG. 10 shows a gravity traction position of the user's inverted body.

FIGS. 11-14 are views showing different views of the equipment; and FIGS. 15-18 show selectable angular positions of leg supports 15.

Using Dr. Leroy Perry's Spinal Decompressor is simple. Leaning forward in an inverted position, just relax and breath, and let your muscles elongate. Dr. Leroy Perry's Spinal Decompressor adds to and reinforces yoga principles. The user can perform body inverted active exercises, which elongate and decompress the spine. Decompressing the spine increases nerve supply and circulation throughout the body, thereby supplying more oxygen to all organs and tissues. Benefits obtained include relief of back pain, and an increase in vitality, stamina, strength and flexibility.

Projecting hand holds 100 are provided on frame legs, at different elevations, to be grasped by the user to assist in stabilizing his body during rotation and inverting about axis 12.

I claim:

1. A bodily exercise equipment, comprising:

a) an upright frame and an assembly rotatable about a primary transverse axis while supported by the frame, the assembly including i) a body support platform and support structure supporting the platform, ii) a leg support spaced from the platform, iii) a linearly adjustable element carried by the support structure to linearly adjust the position of the leg support relative and the platform, iv) an angularly adjustable element or elements carried by the linearly adjustable element to angularly adjust the position of the leg support about a second transverse axis relative to the platform, b) a space between the platform and the leg support allowing a standing user to position his body adjacent the platform and to position his legs adjacent the leg support, c) there being a vertically adjustable post or posts carried by the frame that support the assembly for substantially vertical adjustment by the standing user, d) the assembly then being rotatable to a selected position or positions by the user while the user is confined in position by the platform and the leg support, e) and including a cross bar supported by the posts for rotation about said primary axis, said assembly carried by the cross bar, the cross bar being vertically adjustable with the posts, f) and including a spring or springs associated with the posts to urge them upwardly, the springs compressed by the weight of the assembly and cross bar.

2. The equipment of claim 1 including at least one stop associated with the cross bar and post or posts, positioned to stop rotation of the cross bar when the platform is positioned for engagement by the user's torso or upper legs in standing position, whereby the user's weight is progressively transferred to the platform as the assembly rotates about said primary axis.

3. The equipment of claim 2 including lock means to hold the springs in selectable compressed condition, and in selected post vertically adjusted position or positions.

4. The equipment of claim 1 including lock means to lock the angularly adjustable element or elements to hold the leg support in selected angularly adjusted position about a secondary transverse axis, relation to the platform, whereby leg support of the user's legs is selectively angularly adjusted, for rotation about said primary transverse axis.

5. The equipment of claim 4 wherein said lock means has lock positions at at least three spaced angles, between 0° and 90° , about said secondary axis.

6. The equipment of claim 1 including lock means to lock the linearly adjustable element or elements to hold the leg support in selected linearly adjusted extended position relative to the platform, whereby the leg support is selectively linearly adjusted in spaced relation to said primary axis and to said platform.

7. The exercise equipment of claim 1 wherein the platform support structure is rigidly connected to the cross bar.

8. The equipment of claim 1 wherein said angularly adjustable element defines a brace, said leg support including two transversely spaced, generally cylindrical leg positioners carried by the brace.

9. The equipment of claim 1 wherein said assembly is configured for inducing stretching of the adductor musculature while contracting the abductor muscles producing posterior or external rotation of the user' ilium, thereby inducing distraction of the user's inguinal ligaments and associated adductor musculature anterior, as a result of platform pivoting about the horizontal primary axis with varied degrees of leg, knee, thigh, trunk extension, flexion and rotation, there being hand holds on the frame for grasping during assembly rotation.

10. The equipment of claim 9 which is also configured to allow for varied torso positions from flexion to hyperextension and rotation, which in turn allows the user to achieve enhanced spinal stretching, decompression, and strengthening of the hamstrings, gluteus maximus, erector spinae and other associated spinal muscles, tendons and ligaments while strengthening abdominal core strength.

11. The equipment of claim 1 including multiple user hand grips carried by and protruding from the frame.

12. The equipment of claim 1 wherein said assembly is configured for user weight shifting controlled rotation about the horizontal axis for inducing user performance stretching of the opposite abductor musculature while contracting the adductor muscles producing anterior or internal rotation of the user's ilium, thereby inducing distraction of the user's sacroiliac joints and associated abductor musculature posterior with both anterior and posterior movements of the ilium achieved as the result of pivoting about said horizontal axis with varied degrees of leg, knee, thigh, trunk extension, flexion and rotation.

13. The equipment of claim 1 including handholds on frame angularly separated legs, below the level of said assembly, for grasping during body rotation and inverting.

14. The equipment of claim 1, characterized in that c) the rotatable assembly is positioned rotatably and vertically, relative to a user's body in standing position to adjustably locate the platform lengthwise adjacent a selected frontal part of the user's body, d) said linearly adjustable element is adjusted to selectively position the location of the leg support relative to the located platform and to the user's legs, and e) said angularly adjustable element or elements extends at a selected angle between 0° and 90° to locate the leg support angularly adjacent the standing user's legs.

15. The method of providing positioning, and of using rotary body supporting exercise equipment, that includes:

a) providing an upright frame and an assembly rotatable about a primary transverse axis while supported by the frame, the assembly including i) a body support platform and support structure supporting the platform, ii) a leg support spaced from the platform, iii) a linearly adjustable element carried by the support structure to linearly adjust the position of the leg support relative and the platform, iv) an angularly adjustable element or elements associated with the linearly adjustable element to angularly adjust the position of the leg support relative to the platform, b) a space between the platform and the leg support allowing a standing user to position his torso or upper legs adjacent the platform, and to position his lower legs adjacent the leg support, c) positioning the rotatable assembly, rotatably and vertically, relative to a user's body in standing position, thereby adjustably locating the platform lengthwise adjacent a selected frontal part of the user's body, d) linearly adjusting the linearly adjustable element thereby adjusting the location of the leg support relative to the located platform and to the user's legs, e) angularly adjusting the angularly adjustable element or elements at a selected angle between 0° and 90° thereby locating the leg support angularly adjacent the standing user's legs, f) locking the rotatable assembly into a selected vertical position relative to the standing user, prior to rotation of the assembly, and providing a cross bar supporting said rotatable assembly, and spring-urged posts supporting said cross bar, said locking including locking the posts into selected vertical positions while the posts are subjected to spring urged pressure tending to elevate the posts.

* * * * *